166-307 SR
7/10/79 XR 4,160,482

United States Patent [19]
Erbstoesser et al.

[11] 4,160,482
[45] Jul. 10, 1979

[54] BALL SEALER DIVERSION OF MATRIX RATE TREATMENTS OF A WELL

[75] Inventors: Steven R. Erbstoesser; Thomas W. Muecke; Claude E. Cooke, Jr., all of Houston, Tex.

[73] Assignee: Exxon Production Research Company, Houston, Tex.

[21] Appl. No.: 914,649

[22] Filed: Jun. 12, 1978

Related U.S. Application Data

[63] Continuation-in-part of Ser. No. 830,728, Sep. 6, 1977, abandoned.

[51] Int. Cl.[2] ..... E21B 33/13; E21B 43/27
[52] U.S. Cl. ..... 166/284; 166/307
[58] Field of Search ..... 166/284, 305 R, 296, 166/307, 281, 282

[56] References Cited

U.S. PATENT DOCUMENTS

| | | | |
|---|---|---|---|
| 2,754,910 | 7/1956 | Derrick et al. | 166/284 |
| 2,933,136 | 4/1960 | Ayers et al. | 166/284 |
| 3,010,514 | 11/1961 | Fox | 166/284 |
| 3,086,587 | 4/1963 | Zandmer et al. | 166/284 |
| 3,144,049 | 8/1964 | Ginsburgh | 166/284 X |
| 3,174,546 | 3/1965 | Flickinger | 166/269 |
| 3,301,327 | 1/1967 | Patton et al. | 166/305 R |
| 3,376,934 | 4/1968 | Willman et al. | 166/284 X |
| 3,437,147 | 4/1969 | Davies | 166/284 |
| 3,645,331 | 2/1972 | Maurer et al. | 175/65 |

OTHER PUBLICATIONS

Ishmurzin et al., "Experimental Use of Temporary Packing Spheres for Separate Treatment of Zones in Water Injection Wells", *Nauch. Tech. SB. Ser. Neftepromyelovoe Delo,* No. 9, pp. 14–16, 1969.

Brown, R. W. et al., "Stimulation Treatment Selectivity Through Perforation Ball Sealer Technology", *The Petroleum Engineer,* Jun. 1959.

Howard, E., "Ball Sealers in Fracturing and Acidizing", *Canadian Oil and Gas Industries,* pp. 43–46, Jan. 1962.

Neill, G. H. et al., "An Inexpensive Method of Multiple Fracturing", *Drilling and Production Practice,* pub. by American Petroleum Institute, 1958, pp. 27–32.

Permeator Corporation (Canada) Ltd., "Permeator Well Completion Operator's Manual", Revised Sep. 1967, copyright 1964.

Dowell Data Sheets, Well Treatment Reports, TN-1-5-05-0325, TN-15-0328, TN-15-05-0361, TN-15-0-5-0363, TN-07-8599, TN-15-06-6566, TN-15-0-7-4378, TN-15-07-3654, TN-15-07-7917.

*Primary Examiner*—Stephen J. Novosad
*Attorney, Agent, or Firm*—Salvatore J. Casamassima; Robert B. Martin

[57] ABSTRACT

A method for sequential treatment of formation strats when treating fluid is pumped into a well at a matrix rate by temporarily closing perforations in the well casing. The perforations are closed by ball sealers injected into the wall during the treatment. The ball sealers are sized to plug the perforations and have a density less than the density of the treating fluid. The treating fluid is injected at a rate which transports the ball sealers to the perforations but which is sufficiently low to prevent formation fracture.

17 Claims, 5 Drawing Figures

BALL SEALER DIVERSION OF MATRIX RATE TREATMENTS OF A WELL

CROSS-REFERENCE TO RELATED APPLICATIONS

This application is a continuation-in-part of application Ser. No. 830,728; filed Sept. 6, 1977 now abandoned.

BACKGROUND OF THE INVENTION

1. Field of the Invention

This invention pertains to the matrix rate treatment of wells and more in particular to the sequential treatment of formation strata by the temporary closing of perforations in the well casing during the treatment.

2. Description of the Prior Art

It is common practice in completing oil and gas wells to set a string of pipe, known as casing, in the well and use cement around the outside of the casing to isolate the various formations penetrated by the well. To establish fluid communication between the hydrocarbon bearing formations and the interior of the casing, the casing and cement sheath are perforated.

At various times during the life of the well, it may be desirable to increase the production rate of hydrocarbons through a matrix treatment stimulation. Matrix treatments are stimulation treatments which are injected at pressures below the fracture pressure of the formation. In other words, the fluid is being forced into the formation at a rate such that the pores of the formation accept the flow without fracturing the formation. A common example of a matrix rate treatment is matrix acidization whereby an acid bearing fluid is injected into the formation so that the acid can permeate into the near wellbore area of the formation and increase permeability. Generally, acidization is limited to within a few feet of the wellbore. The purpose of a matrix acidization treatment is to dissolve near wellbore damage such as clays and formation fines which clog or constrict the formations' fissures and channels. Other types of well treatment fluids such as solvent surfactants can also be applied in matrix rate treatments.

It is the objective in a matrix treatment stimulation to inject the treating fluid into the zones of the formation where treatment is required. But as the length of the perforated pay zone or the number of perforated pay zones increases, the placement of the fluid treatment in the regions of the pay zones where it is required becomes more difficult due to differences in formation characteristics. For instance, the strata having the highest permeability will most likely consume the major portion of a given stimulation treatment leaving the least permeable strata virtually untreated. Therefore, techniques have been developed to divert the treating fluid from its path of least resistance so that the low permeability zones are also treated.

One technique for achieving diversion involves the use of particulates such as rock salt and benzoic acid flakes. Typically particulates are solids having limited solubility in the treating fluid but are soluble in the produced fluids. The particulates are added to the treating fluid during the treatment and plug the formation as they are carried by the fluid through the perforations and into the formation pores. As certain sections of the formation get plugged, the treating fluid is diverted and forced to flow into the unplugged sections of the formation. The formation is unplugged after the treatment by dissolving the particulates as the well is either flushed or produced. Dissolving the particulates can at times be a difficult task. The major drawback of particulates is that if the proper fluid which will dissolve the particulates cannot be brought into contact with the particulates, the particulates will remain solid particles blocking the flowpaths for the produced fluids into the well, thereby permanently damaging the production capability of the well and defeating the purpose of the treatment.

Ball sealers provide a diverting technique which avoids this problem. Ball sealers are small rubber coated balls which are sized to seal off the perforations inside the casing. When ball sealers are used, they are pumped into the wellbore along with the treating fluid. The balls are carried down the wellbore and onto the perforations by the directional flow of the fluid through the perforations into the formation. The balls seat upon the perforations and are held there by the pressure differential across the perforations. The major advantages of utilizing ball sealers as a diverting agent are their ease of use, positive shut-off, independence of formation conditions, and inertness. The ball sealers are simply injected at the surface and transported by the treating fluid to the perforations to be plugged. Other than a ball injector, no special or additional treating equipment is required. The ball sealers are designed to have an outer covering sufficiently compliant to seal a jet or bullet formed perforation and to have a solid, rigid core which resists extrusion into or through the perforation. Therefore, the ball sealers will not penetrate the formation and permanently damage the flow characteristics of the well.

Although ball sealers have been frequently and successfully used as diverting agents in fracturing operations, they have rarely been used as diverting agents in matrix rate treatments because in matrix treatments they generally have been ineffective. Their ineffectiveness is due to the relatively low flow rate of the treating fluid through the perforations during a matrix treatment. The seating efficiency of most commercially available ball sealers used according to present-day practices is a function of the flow rate through the perforations. It has been generally accepted in the art that the greater the flow rate of the treating fluid through the perforations, the greater the seating efficiency of the ball sealers will be. When the flow rate through the perforations is very low, the seating efficiency of ball sealers, as presently used, is extremely low because the low flow rate will not effectively carry the ball sealers to the perforations before they sink past the perforations. Since ball sealers have been so ineffective in diverting matrix rate treatments, they have rarely been used in such treatments.

SUMMARY OF THE INVENTION

The method of the present invention overcomes the limitations of the current ball sealer diversion methods when the treating fluid is pumped at matrix rates. The present invention utilizes buoyant ball sealers having a tentacle-free outer surface and a density less than the treating fluid. Use of the buoyant ball sealers surprisingly produces 100% seating efficiency, i.e., each injected ball sealer will seat on and seal an unsealed perforation.

The present invention's method for diverting treating fluid during a matrix treatment involves flowing the treating fluid downward within the casing and through the perforations into the formation surrounding the perforated parts of the casing. At the appropriate time during the treatment, ball sealers are introduced into the treating fluid and pumped down the casing to the casing perforations. Ball sealers are selected which have a density less than the density of the treating fluid within the casing but which are capable of being downwardly transported to the perforations by the downward flow of the fluid within the casing. Therefore, the injection of the treating fluid into the casing must be established at a rate such that the downward velocity of the fluid in the casing above the perforations is sufficient to impart a downward drag force on the ball sealers greater in magnitude than the upward buoyancy force acting on the ball sealers thereby transporting the ball sealers to the perforations. However, the velocity of the treating fluid must be sufficiently low to provide a matrix rate treatment which does not fracture the formation. Once the ball sealers have reached the perforations, they will all seat on and plug those perforations taking fluid. The treating fluid will then be diverted to the remaining open perforations.

After the treatment of the hydrocarbon-bearing strata is completed, the pressure on the fluid in the casing is relieved causing the ball sealers to be released from those perforations on which they were seated. The ball sealers, being lighter than the treating fluid, will buoyantly rise within the casing. A ball catcher may be provided to trap all of the ball sealers upstream of any equipment which they might clog or damage.

The method of the present invention provides certainty in diversion heretofore unknown in matrix rate well treatment operations.

DESCRIPTION OF THE PREFERRED EMBODIMENTS

Figure 1:
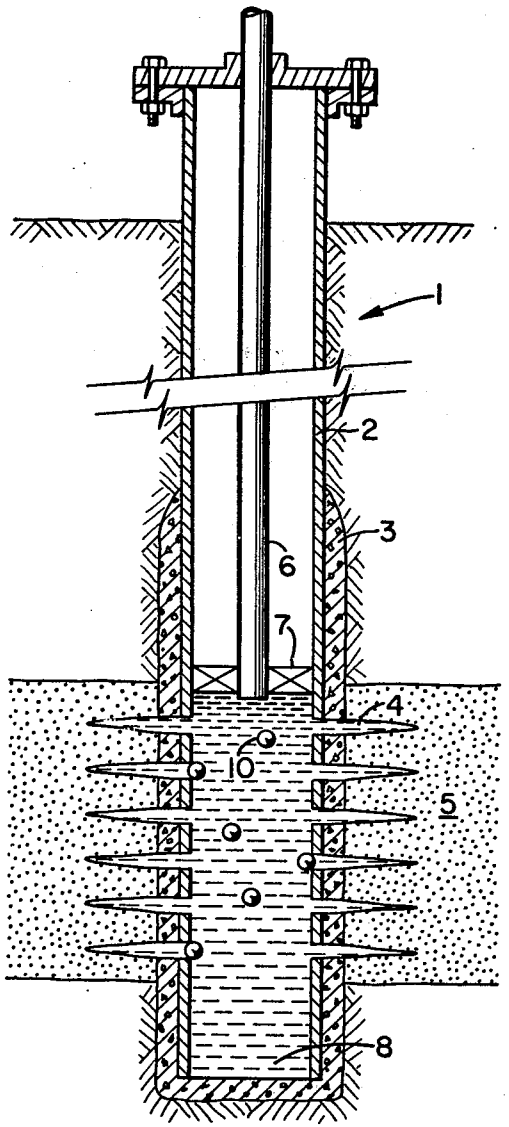
FIG. 1 is an elevation view in section of a well illustrating the practice of the present invention.

Utilization of the present invention according to the preferred embodiment is depicted in FIG. 1. The well 1 of FIG. 1 has a casing 2 run to the bottom of the wellbore and cemented around the outside to hold the casing in place and isolate the penetrated formations or intervals. The cement sheath 3 extends upward from the bottom of the wellbore at least to a point above the producing strata 5. For the hydrocarbons in the producing strata 5 to be produced, it is necessary to establish fluid communication between the producing strata 5 and the interior of the casing 2. This is accomplished by perforations 4 made through the casing 2 and the cement sheath 3 by a jet or bullet perforation gun as is well known in the art.

The hydrocarbons flowing out of the producing strata 5 through the perforations 4 and into the interior of the casing 2 are transported to the surface through a production tubing 6. A production packer 7 is installed near the lower end of the production tubing 6 and above the highest perforation to achieve a pressure seal between the production tubing 6 and the casing 2. Production tubings are not always used and, in those cases, the entire interior volume of the casing is used to conduct the hydrocarbons to the surface of the earth.

In the past, when it was desired to use ball sealer diversion during a fracture treatment, the prior art taught that the preferred density of the ball sealers be greater than the density of the treating fluid. It is worth examining the prior art ball sealer seating mechanism to be able to contrast it to the present invention which allows the use of ball sealers for diversion at matrix rates. The velocity of ball sealers more dense than the fluid in the wellbore is comprised of two components. Each ball sealer has a "settling" velocity which is due to the difference in the densities between the ball sealer and the fluid and is always a vertically downward velocity. The second component of the ball sealer's velocity is attributable to the drag forces imposed upon the ball sealer by the moving fluid shearing around the ball sealer. This velocity component will be in the direction of the fluid flow. Within the production tubing and within the casing above the perforations, the velocity component due to the fluid flow will be generally downward.

Just above the perforated part of the casing the fluid takes on a horizontal velocity component directed radially outward toward and through the perforations 4. The flow through any perforation must be sufficient to draw the ball sealer 10 to the perforation before the ball sealer sinks past that perforation. If the flow of the treating fluid through the various perforations does not draw the ball sealer to a perforation by the time the ball sealer sinks past the lowest perforation, the ball sealer will simply sink into the rathole region 8 where it will remain.

The present invention contemplates the use of ball sealers 10 having a density less than the density of the treating fluid. Within the wellbore, each ball sealer has a velocity comprised of two components. The first velocity component is directed vertically upward, a "rising" velocity, and is caused by the buoyancy of the ball sealer in the fluid. The second velocity component is attributable to the drag forces imposed upon the ball sealer by the motion of the fluid shearing past the ball sealer. Above the perforations, this second velocity component will be directed generally downward. It is essential that the downward fluid velocity in the production tubing 6 and inside the casing 2 above the perforations 4 be sufficient to impart a downward drag force on the ball sealers which is greater in magnitude than the upward force of buoyancy acting on the ball sealers. This results in the ball sealers being carried downward to the section of the casing which has been perforated. However, the fluid velocity must be at a matrix rate which is less than that which would cause the formation to fracture.

When ball sealers are utilized in accordance with the method of the present invention, they will never remain in the rathole region 8; that is, below the lowest perforation through which the treating fluid is flowing, due to the buoyancy of the ball sealers. Below the lowest perforation accepting the treating fluid, the fluid in the wellbore remains stagnant. Hence, there are no downwardly directed drag forces acting on the ball sealers to keep them below the lowest perforation taking the treating fluid and the upwardly buoyant forces acting on the ball sealers will therefore dominate in this interval. Consequently, the practice of the present invention results in the vertical velocity of each ball sealer being a function of its vertical position within the casing. Below the lowest perforation, and possibly higher if little fluid is flowing down to and through the lower perforations, the net vertical velocity of each ball sealer will be upward due to the dominance of the buoyancy force over any downward fluid drag force. Above the highest perforation, and possibly lower if little fluid is flowing through the higher perforations, the net vertical velocity of each ball sealer will be downward due to the dominance of the downward fluid drag force over the buoyancy force.

The ball sealers having a density less than the density of the treating fluid will remain within, or move toward, the perforated interval of the casing through which fluid is flowing until the ball sealers seat upon a perforation. While within that interval of the casing, the motion of the fluid toward and through the perforations will exert drag forces on the ball sealers to move them toward the perforations where they will seat and be held there by the pressure differential. When the ball sealers reach the perforated interval, the drag forces caused by fluid flowing through the perforations will cause some of the ball sealers to seat on some of the perforations, usually the perforations receiving disproportionately high volumes of fluid. Individual perforations will be sealed until a portion of the perforated interval becomes sufficiently sealed to reduce the flow rate through the interval. Reduction of the flow rate reduces the downward drag forces imparted on the suspended ball sealers to a level less than the upward buoyancy forces. When this level is reached, any suspended ball sealers within the partially sealed portion will rise until the drag force of fluid flowing into the perforations cause the ball sealers to be carried onto such perforations. If, during the treatment a lower perforation is opened as a result of the treatment, the downward flow and resulting drag forces will cause the ball sealers to be carried to the lower perforations. In this manner, a suspended buoyant ball sealer may actually move down, up, and back down the perforated interval until an open perforation receiving fluid is found.

The net result of the use of the present invention is that the ball sealers injected into the well and transported to the perforated zone of the casing will always seat upon and plug the perforations through which fluid is flowing with an invariable 100% efficiency. That is, each and every ball sealer will seat and plug a perforation as long as there is a perforation through which fluid is flowing such that the fluid flow down the casing above the uppermost perforation is sufficient to impart a downward drag force on each ball sealer greater in magnitude than the buoyancy force acting on that ball sealer.

Upon completion of a treatment using ball sealers having a density less than the treating fluid, as taught by the present invention, all ball sealers will unseat from the perforations and naturally migrate upward. Therefore, some means should be provided to catch the ball sealers before they pass into production equipment which they might clog or damage. A ball catcher 30 which will accomplish this is depicted in FIG. 2.

Figure 2:
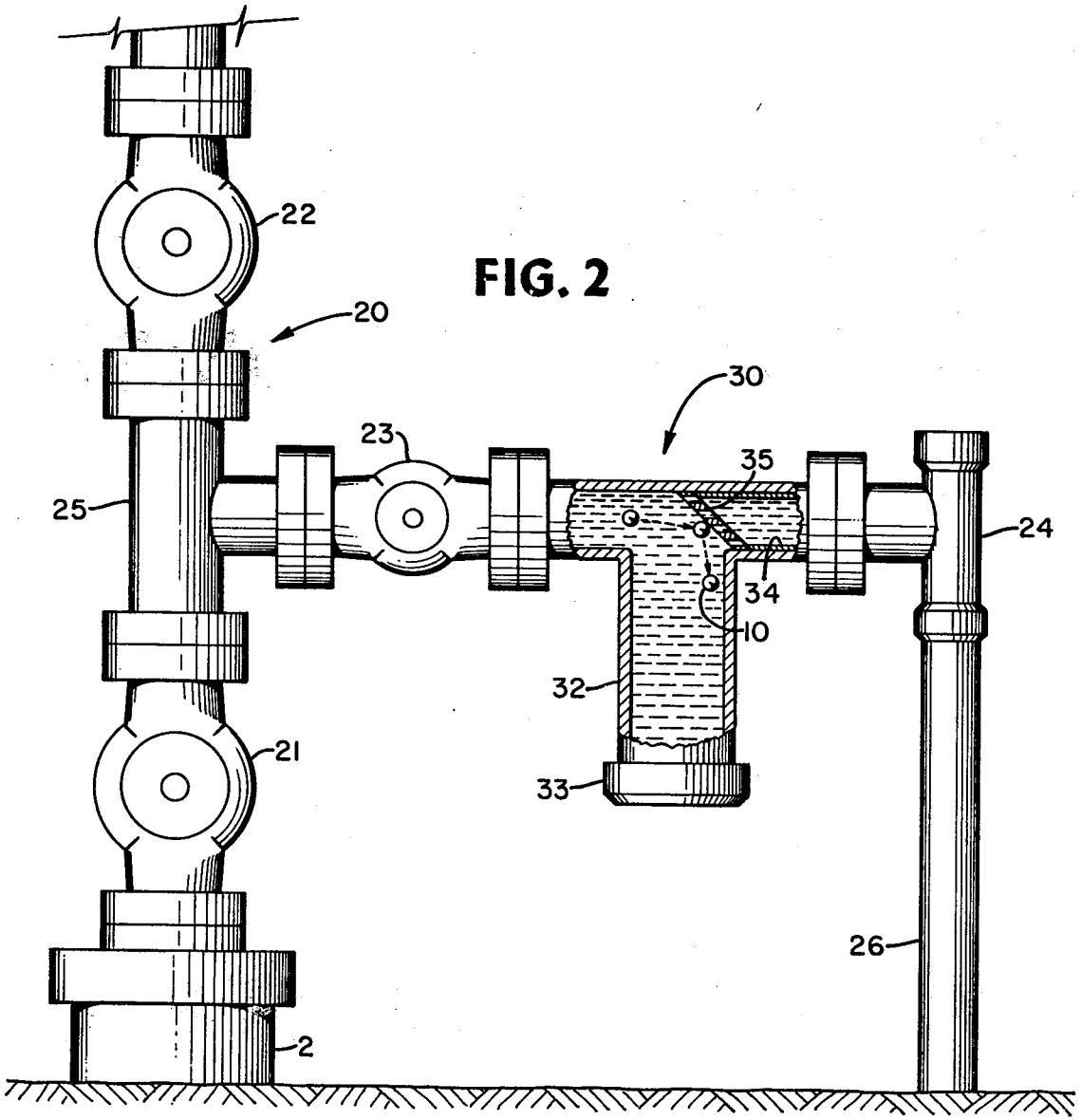
FIG. 2 is an elevation view partially in section of a typical arrangement of wellhead equipment placed on a production well to control the flow of hydrocarbons from the well including a ball catcher adapted to trap the ball sealers upstream of any equipment which they might clog or damage.

FIG. 2 shows a typical arrangement of wellhead equipment for a producing well. The well casing 2 extends slightly above the ground level and supports the wellhead or "christmas tree" 20. The production tubing 6 is contained within the casing 2 and connects with the lower end of the master valve 21. The master valve 21 controls the flow of oil and gas from the well. Above the master valve 21 is a tee 25 which provides communication with the well either through the crown valve 22 or the wing valve 23. Various workover equipment can be attached to the upper end of the crown valve 22 and communication between that equipment and the well is accomplished by opening the crown valve 22 and the master valve 21. Ordinarily the crown valve 22 is maintained in a closed position. Production from the well flows through the tee 25 laterally through the wing valve 23. The wing valve 23 directs the flow of fluids from the wellhead to the gathering flowline 26.

A ball catcher 30, shown in section, is located downstream of the wing valve and upstream of the flow controlling choke 24. The produced fluid will pass through the ball catcher 30 but the ball sealers will be trapped therein. After the produced fluid passes through the choke 24 it moves into a gathering flowline 26 which will transport the fluid to a separation facility and then either to holding tanks or to a pipeline.

The ball catcher 30 is basically a tee having a deflector insert 34 containing a deflector grid 35 inserted into the downstream end of the tee. The deflector grid 35 allows fluid to pass through it but it will not allow objects the size of the ball sealers to proceed further downstream. Preferably the deflector grid 35 is angled within the ball catcher 30 so that when the ball sealers strike the deflector grid 35, they will be deflected into the tee's deadleg 32. A deadleg cap 33 is attached to the lower end of the deadleg 32 and can be easily removed, when the wing valve is closed and the pressure bled down, to allow the removal of the trapped ball sealers.

EXPERIMENTS

Experiments were conducted to test the seating efficiencies of ball sealers when the ball sealers have a density greater than the treating fluid and when the ball sealers have a density less than the density of the treating fluid. The laboratory experiments were designed to simulate ball sealers seating on perforations in a casing. The experimental equipment included an 8-foot long piece of 3-inch lucite tubing to represent a section of casing. The lucite tubing was mounted vertically in the laboratory and its lower end sealed closed. Between 3 and 4 feet from the bottom of the tubing, five vertically aligned holes were drilled through the wall of the tubing to represent perforations. The holes were $\frac{3}{8}$-inch in diameter and spaced 2 inches apart on center.

A 90° elbow was placed on the upper end of the lucite tubing and was connected by a flowline to a pump. The pump drew fluid from a reservoir tank and pumped it at various controlled rates through the flowline and into the upper end of the tubing. The fluid flowed down the lucite tubing, through the perforations and returned by a flowline to the reservoir tank.

To inject the ball sealers, a suitable hole was made in the elbow and a 1-inch diameter piece of tubing welded in the hole. The end of the 1-inch tubing was centered to be coaxial with the lucite tubing at the upper end of the lucite tubing. The ball sealers were introduced into the lucite tubing through the 1-inch tubing.

The flow of fluid into the upper end of the lucite tubing was measured. It was assumed that the flow through each perforation was the same and therefore the flow through each perforation was taken to be 1/5 of the measured flow into the upper end of the lucite tubing.

During the first phase of experiments, water, having a density of 1.0 grams per cubic centimeter (g/cc), was used as the fluid. Rigid ball sealers were made from four different materials having different densities. The balls were all ¾" in diameter and were made respectively from polypropylene (0.84–0.86 g/cc density), nylon (1.11 g/cc density), acetal (1.39 g/cc density) and teflon (2.17 g/cc density). Although these ball sealers did not have an elastomeric cover, in actual practice, ball sealers are usually covered with an elastomer so that they effect a better seal. However, for the purpose of these experiments which was to observe seating characteristics and not sealing characteristics, the elastomeric covering was not essential.

The experiment generally involved establishing a specific flow rate of the fluid through the perforations, injecting the ball sealers through the 1-inch tubing into the upper end of the 8-foot lucite tubing and observing whether or not the ball sealers seated on the perforations. The experimental program was conducted with ball sealers made of all four materials being injected into the tubing with the water flowing through the tubing at various flow rates.

A single set of tests involved injecting ten balls of the same material, one at a time, into the top of the 8-foot lucite tubing. An observation was made whether or not the ball sealer seated on one of the perforations. If a ball seated on a perforation, that ball was released from the perforation prior to dropping the next ball, so that there were always five open perforations for each ball to seat upon. During a single set of tests the fluid and its flow rate remained unchanged. After all ten balls had been dropped, the number that seated upon perforations was defined as the seating efficiency under those conditions and expressed as a percentage.

Figure 3:
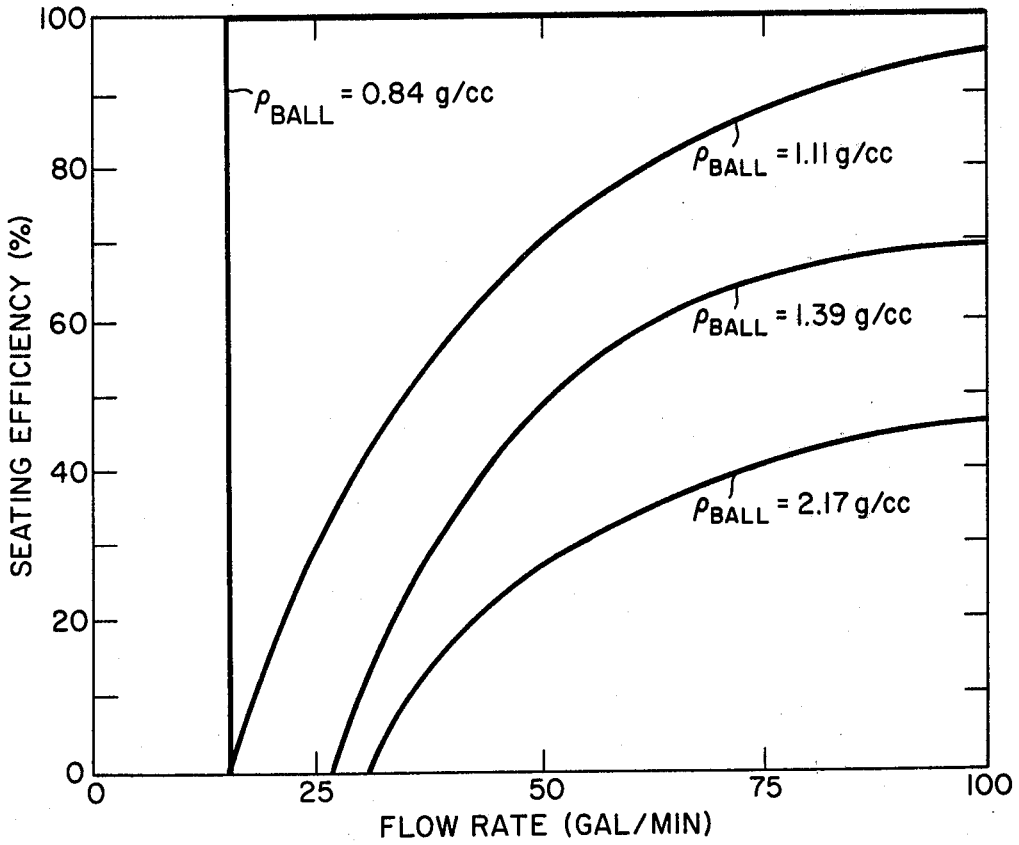
FIG. 3 is a graph of the seating efficiency versus the flow rate of the fluid per perforation based on experiments.

Tests were conducted to define a regression curve plotting seating efficiency against flow rate for each of the ball sealers tested. The data from those regression curves was then used to make the graph of FIG. 3. The graph of FIG. 3 plots seating efficiency for the ball sealers tested versus flow rate. Since there were five perforations in the lucite tubing, the flow rate through each casing is readily obtainable by dividing the total flow rate by five. FIG. 3 shows that the seating efficiency of ball sealers having a density greater than that of the treating fluid significantly decreases with decreasing flow rate. By comparison, the seating efficiency of the buoyant ball sealer (0.84 g/cc) remains at 100% down to a flow rate of about 15 gallons per minute. Below this flow rate seating efficiency drops to zero percent. As will be illustrated and discussed later, adjustments would be necessary in the density contrast to obtain 100% seating efficiency at flow rates below 15 gpm for this particular situation.

As discussed previously, the reason why ball sealers have traditionally not been used for matrix rate treatments is that their seating efficiency is very poor at matrix flow rates. FIG. 3 verifies this presumption for ball sealers having a density greater than the treating fluid. A total flow rate of under 25 gallons per minute, corresponding to a per perforation flow rate of about 5 gpm, simulates a relatively high flow rate at which a matrix treatment could be conducted without fracturing the formation. At this rate, ball sealer efficiencies for the denser than fluid balls is at or near zero percent. When the density of the ball sealers is greater than the density of the fluid, the seating efficiency of the ball sealers is primarily a function of the flow rate through the perforation. The greater the flow rate through the perforation the greater will be the seating efficiency. However, the seating efficiency of ball sealers having a density greater than the density of the fluid is strictly a statistical phenomenon. A variation in the number, spacing and orientation of the perforations is highly likely to affect the precise seating efficiency which can be expected in a given situation. Therefore, since the seating of ball sealers having a density greater than the density of the fluid is a statistical phenomenon, there is always the possibility that too few or too many of the ball sealers will seat to get the desired diversion. Nevertheless, at matrix rates the seating efficiency of heavier than fluid ball sealers will invariably be very poor.

In contrast to the performance of the ball sealers having a density greater than the density of the fluid is the performance of the buoyant ball sealer. As noted above, the 0.84 g/cc ball sealer has a seating efficiency of 100% at flow rates above 15 gpm. The seating efficiency of a ball having a density less than the fluid density will always be 100% provided the downward flow of fluid in the casing above the perforations is sufficient to impart a downward drag force on the ball sealers which is greater in magnitude than the upward buoyancy force acting on the ball sealers. In other words, if the downward flow of fluid within the casing is sufficient to transport the ball sealers downward to the perforations, they will always seat. The quantum jump in the seating efficiency of the buoyant ball from 0% to 100% at about 15 gpm represents the lowest flow rate at which the buoyant ball can be transported down the well. In this particular example, below a flow rate of about 15.3 gpm, the upward buoyancy of the ball overcomes the downward flow of the treating fluid thus preventing downward transport of the ball sealers to the perforations. On the other hand, when the downward flow within the casing transports the ball sealers to the level of the perforations, the ball sealers seat. A predictable, non-statistical diversion process is thereby attained since the number of perforations plugged by the ball sealers will be equal to the lesser of the number of ball sealers injected into the casing or the number of perforations accepting fluid.

Figure 4:
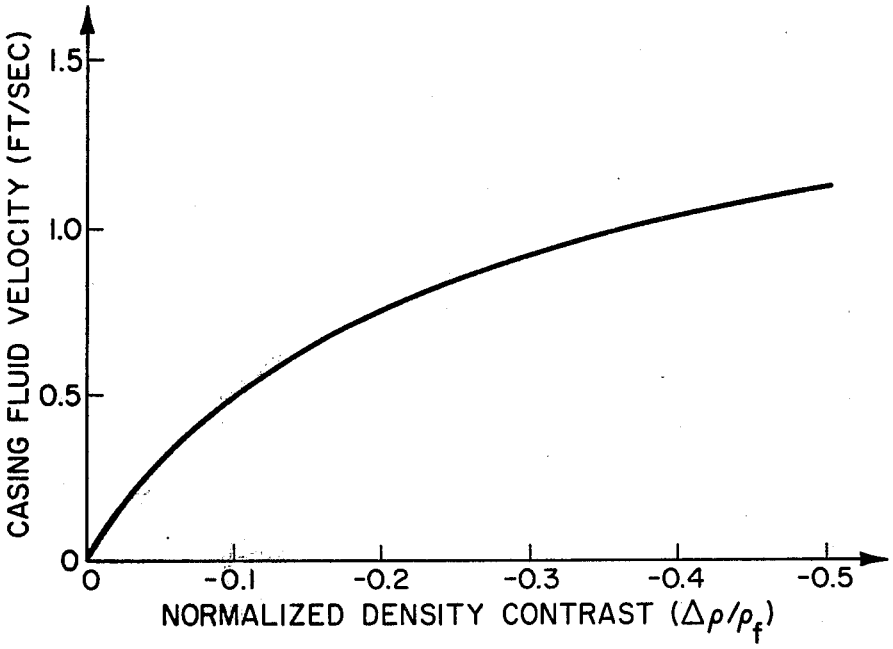
FIG. 4 is a graph of the fluid velocity within the casing versus the normalized density contrast between a ball sealer and a treating fluid based on experiments.

The relationship between density contrast and the fluid velocity needed to transport the ball sealers down the casing was investigated. FIG. 4 is a graph of the normalized density contrast between the ball sealers and the fluid plotted against the velocity of the fluid downward within the casing. The normalized density contrast is the difference in density between the ball sealer and the fluid divided by the density of the fluid. A positive normalized density contrast means the density of the ball sealer is greater than the density of the fluid and a negative normalized density contrast means the density of the ball sealer is less than the density of the fluid. It follows that a normalized density contrast of zero means that the ball sealer and the fluid have the same density. The graph of FIG. 4 is based upon several tests which involved placing a ball sealer within a vertical piece of lucite tubing and flowing fluid downward through the tubing. The velocity of the fluid was adjusted until the ball sealer was maintained in a fixed position at the midpoint of the tubing. In that equilibrium position the drag forces of the fluid shearing past the ball sealer were equal in magnitude to the buoyancy forces acting on the ball sealer. Ball sealers of several densities were used in conjunction with two fluids, water and 1.3 g/cc calcium chloride brine, to yield the plot of FIG. 4.

The solid line defines the equilibrium condition wherein the ball sealer will remain stationary within the casing, moving neither upward nor downward. Below the line in FIG. 4 the velocity of the fluid in the casing would be insufficient to overcome the force of buoyancy and the ball sealers will rise in the casing. Above the line in FIG. 4 the velocity of the fluid in the casing exerts a drag force on the ball sealers greater in magnitude than the force of buoyancy acting on the ball sealers. Therefore, the ball sealers will be transported down the casing.

All points on the line and below it correspond to a certain normalized density contrast and a certain casing velocity which will result in a seating efficiency of zero percent because the ball sealers are not transported down to the perforations. However, if the normalized density contrast and casing velocity define a point which is above the line plotted in FIG. 4, the seating efficiency will be 100% because ball sealers are transported to the perforations on which they will seat. Their buoyancy will maintain them at a position at or above the lowermost perforation and the downward fluid velocity in the casing above the uppermost perforation will maintain the ball sealers at or below the level of the uppermost perforation.

It will take a very small fluid flow through a perforation to draw a ball sealer to the perforation and seat it thereon when the amount of time the fluid flow through the perforation has to act upon the ball sealer is limited only by the length of the injection time. This, however, is a very important limitation in that the ball sealer cannot take an infinite or a very long time to reach the perforations. Although the treating fluid may have a sufficient casing velocity to transport the buoyant ball sealers down the well, it may take an inordinate amount of time to do so. Therefore, a constraining factor is the amount of treating fluid which is transporting the ball sealers down to the perforations. For the invention to be operable the balls must seat before the entire amount of treating fluid is injected through the perforations. Preferably, the ball sealers should be seated at an early or intermediate stage of the injection process. Thus the ball sealers' buoyancy cannot transport them upwardly at a rate which will make them traverse more than the length of the entire interval of treating fluid injected into the well. This concept and the limitations it imposes will be further discussed in the Design Example.

As a final test of the seating efficiency of ball sealers having varying density, a series of experiments were conducted which compared seating efficiencies for various normalized density contrasts at a constant flow rate. In this test, a 3-inch diameter section of lucite tubing containing ten vertically aligned ⅜-inch perforations was used as the simulated casing. The flow rate of the carrier fluid was maintained at a constant 15 gpm or 1.5 gpm per perforation. This flow rate was selected as being typical of a matrix rate treatment. During the tests, treating fluid densities were varied and ball sealers of varying density were selected so that a relatively wide range of normalized density contrasts of between −0.27 and +0.08 were obtained.

Figure 5:
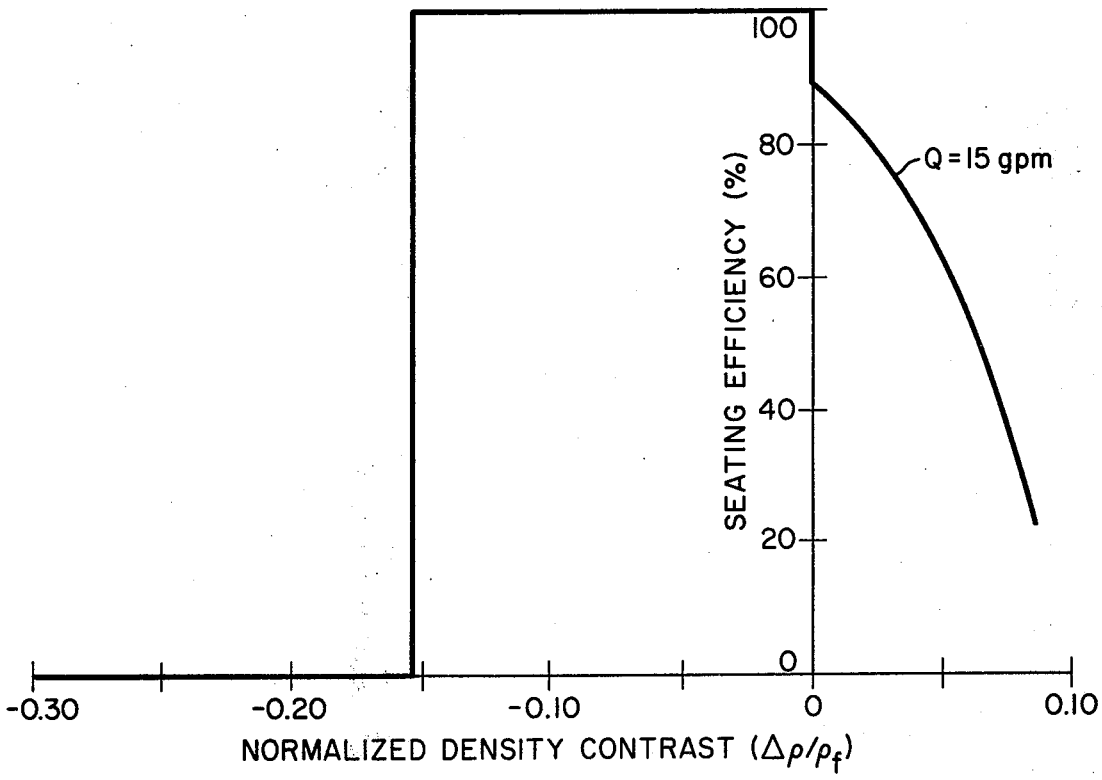
FIG. 5 is a graph of the seating efficiency versus the normalized density contrast between a ball sealer and a treating fluid based on experiments.

The results of this test are shown in FIG. 5 which is a plot of seating efficiency versus normalized density contrast for a constant flow rate of 15 gpm. As might be expected from the experiments previously discussed, the seating efficiencies of ball sealers having a positive density contrast were less than 100 percent. Furthermore, such ball sealers exhibit a steeply decreasing seating efficiency as density contrast increases. These results are consistent with those shown in FIG. 3 wherein the 2.17 g/cc ball sealer had a substantially lower seating efficiency than the 1.11 g/cc or 1.39 g/cc ball sealers at comparable flow rates.

Of greater importance are the test results shown in FIG. 5 for the ball sealers having negative density contrasts. For normalized density contrasts less than 0.00 but greater than about −0.15, the ball sealers achieved a seating efficiency of 100 percent. FIG. 5 establishes that a range of ball sealer densities will achieve 100 percent seating efficiency. That range, however, is finite and will not encompass all buoyant ball sealers. Beyond a density contrast of about −0.15, the ball sealers were so buoyant that they could not be transported downwardly to the perforations by the treating at the given flow rate of 15 gpm, hence the zero percent seating efficiency.

The experimental results thoroughly support the results shown in FIG. 3 for the buoyant ball sealer having a density of 0.84. That ball sealer which had a normalized density contrast of −0.16 attained a 100 percent seating efficiency beyond flow rates of about 15.3 gpm. Below that flow rate, seating efficiency was zero. This result is consistent with FIG. 5 which shows seating efficiency at zero percent for a density contrast of −0.16 at the given flow rate of 15 gpm.

It is a rather unique situation when the normalized density contrast equals zero. As noted previously, the normalized density contrast is zero when the density of the ball sealer is the same as the density of the fluid. There were no tests conducted wherein the ball sealers had the exact same density as the fluid, but the trend of the data indicates that the seating efficiency for a normalized density contrast of zero is somewhat less than 100%. As shown in FIG. 5, the seating efficiency at a normalized density contrast approaching 0.00 g/cc from the positive direction is about 90%. As density enters the negative region, seating efficiency immediately reaches 100%. Thus the data clearly suggests that only a negatively buoyant, and not a neutrally buoyant, ball sealer can attain 100% seating efficiency. At neutral buoyancy it is possible that the ball sealer is carried downward by the fluid to the level of the lowermost perforation without seating and then further carried below the level of the lowermost perforation due to its inertia. Ball sealers having zero density contrast can, if they overshoot the lowermost perforation due to inertia, remain suspended in the rathole without seating if the flow of fluid down the casing and through the perforations does not cause enough turbulence below the lowermost perforation to somehow move ball sealers upward. This situation, as clearly illustrated by FIG. 5, is not possible if the ball sealers are even just slightly less dense than the fluid since the buoyancy of the ball sealers will cause them to rise at least to the level of the lowermost open perforation taking fluid and seat on that perforation.

DESIGN EXAMPLE

For purposes of illustrating the operation of the present invention, a design of a matrix rate acidization treatment employing buoyant ball sealers is discussed below. It is to be assumed that two wells, one equipped with a 3 inch (ID) production casing and the other with 6 inch (ID) casing, are to be matrix acidized. Each well has an extensive stratum or zone in the producing interval, the perforations of which are to be selectively sealed off using the ball sealer technique of the present invention to assure that all perforations are acidized. The characteristics of each well are identical and are as follows:

Formation—Sandstone
Treating Acid—3000 gallons of an HCl-HF mud acid
Well depth (H)=5000 feet
Formation permeability (k)=50 millidarcies
Perforated interval length (h)=50 feet
Fracture gradient (FG)=0.6 psi/ft
Bottom hole pressure ($P_b$)=FG×H
=(0.6 psi/ft) (5000 ft)=3000 psi
Reservoir pressure ($P_r$)=1000 psi
Acid density ($\rho_f$)=1.030 g/cc
Downhole acid viscosity ($\mu$)=0.78 centipoise
Drainage radius of well ($r_e$)=660 feet
Average wellbore radius ($r_w$)=0.1875 feet For field application of a matrix rate acidization, a key limiting factor is that the injection pressure and hence the injection rate must be limited to avoid fracturing the formation. The maximum injection rate that is possible without fracturing the formation is governed by Darcy's radial flow equation, namely:

$$Q_{max} = \frac{4.917 \times 10 - 6\, k\, h\, (P_b - P_r)}{\mu \ln (r_e/r_w)}$$

where $Q_{max}$=maximum injection rate (bbl/min)

Substituting the known information given above into Darcy's equation, it can be readily determined that $Q_{max}$ equals 3.85 barrels per minute or 0.36 $ft^3$/sec. Based on this maximum injection rate, the maximum average flow velocity ($V_{max}$) through the casing can be calculated by dividing $Q_{max}$ by the cross sectional area of the casing. For the 3 inch casing $V_{max}$ equals 7.351 ft/sec and for the 6 inch casing $V_{max}$ equals 1.837 ft/sec. Therefore, the downward velocity of the treating fluid which is necessary to transport the ball sealers to the perforations will be limited by the maximum casing velocity that can be employed without formation fracture.

As noted previously, another essential factor in designing the matrix treatment is that the treating fluid must be capable of transporting the ball sealers down the well in a finite time. If the ball sealers move down the production casing too slowly they may not seat on the perforations during the time in which the treating fluid is being injected. It is, therefore, inherent in practicing the invention that the relative distance in the treating fluid which the ball sealers buoyantly rise be no more than the total length of the treating fluid interval injected in the production casing. The total length of the treating fluid interval is equal to the total volume of the treating fluid divided by the cross sectional area of the casing. For the 3000 gallons of treating acid called for in this example (401 cubic feet), the length of the fluid interval is 8184 feet for the 3 inch tubing and 3069 feet for the 6 inch casing. The time necessary for all of the treating fluid to be injected into the formation is readily calculated by dividing the sum of the fluid interval length and the depth of the well by the velocity of the treating fluid through the casing:

$$t=(L+H)/V$$

where
L=the length of the fluid interval
t=time for fluid injection
H=well depth (5000 ft)
V=average fluid velocity in casing The minimum time, $t_{min}$, for fluid injection is, of course, the time required when the fluid is injected at its maximum velocity, $V_{max}$. Carrying out the necessary computations for the 3-inch casing, $t_{min}$ equals 1793 seconds (about 30 minutes) and for the 6-inch casing, $t_{min}$ equals 4392 seconds (about 73 minutes).

Based on the calculated injection times given above, the maximum upward velocity of the ball sealers is the time necessary for the ball sealers to upwardly move the length of the treating fluid interval or $$U_{max}=L/t_{min},$$

where $U_{max}$=maximum ball sealer velocity

Calculating for $U_{max}$, $U_{max}$ equals 4.564 feet per second for the 3-inch casing and 0.698 feet per second for the 6 inch casing.

For all practical purposes, however, the actual upward velocity of the ball sealers must be substantially less than $U_{max}$ since one would never design a system which would seat the ball sealers on the perforations after almost all of the treating fluid was injected. Secondly, the treating fluid would be injected at slightly less than $V_{max}$ to ensure an adequate safety factor to prevent fracturing. Therefore, for practicing the present invention it is preferable that actual upward velocity of the ball sealer in the treating fluid be no greater than about one third of $U_{max}$.

By setting U=0.25 $U_{max}$ for purposes of illustration, the preferred upward velocity of the ball sealers for the present example should be no greater than 1.141 fps for the 3-inch casing and 0.175 fps for the 6-inch casing. Upon selecting the size of the ball sealers to be used and knowing the characteristics of the treating fluid (density, viscosity) and upward velocity of the ball sealers (U), the Reynolds number for the ball sealers can be calculated. The Reynolds number can then be used to establish the drag coefficient or friction factor for the spherical ball sealers, which in this example is about 0.44 for both cases. (see, for example, Perry's Chemical Engineers Handbook, Fifth Edition, p. 5-62.) Assuming Newtonian fluid behavior, the desired density of the ball sealers can be calculated using the terminal velocity equation for a sphere. Solving that equation for density contrast, the equation becomes:

$$\Delta\rho = \rho_f - \rho_B = \frac{3U^2\, \rho_f\, C_D}{4g\, D_b}$$

where
$\rho_f$=treating fluid density=1.07 g/cc
$\rho_B$=ball sealer density in g/cc
$D_B$=ball sealer diameter=1 inch=0.0833 feet
g=gravitational constant=32.17 ft/$sec^2$
$C_D$=drag coefficient for gall sealers=0.44

Calculating for $\Delta\rho$ using the given data in the example, $\Delta\rho$ equals 0.171 g/cc for the 3-inch casing case and 0.004 g/cc for the 6-inch casing case. Based on the fluid density of 1.070 g/cc, the minimum ball densities are calculated to be 0.898 and 1.066 g/cc for the 3 and 6-inch cases. Thus a two-fold increase in tubing diameter of from 3 to 6 inchs, as illustrated in this example, necessitated more than a forty-fold reduction in calculated density differential. One designing a ball sealer application employing the present invention would, therefore, need to carefully compute the desired ball sealer density based on the characteristics of the well and the treating fluid. Small differences in ball sealer density could make a major difference in performance. For example, in the case of the 6-inch casing, the calculated lower density limit is 1.066 g/cc and the upper limit is the density of the treating fluid, namely 1.070 g/cc. Thus, selection of a suitable buoyant ball sealer for that situation would confine one to the relatively narrow range of between 1.066 g/cc and 1.070 g/cc, or a differential of only 0.004 g/cc.

FIELD EXAMPLES

1. A South Texas brine disposal well completed in three sandstone intervals at about 3600 feet was treated using the method of this invention. Pretreatment analysis consisted of an injectivity test which indicated that the well was potentially damaged and a temperature survey which indicated that essentially all of the fluid was entering the uppermost of the three completed intervals.

Removal of the near-wellbore damage was achieved by a matrix acid stimulation using hydrochloric acid (15% HCl), and mud acid (12% HCl and 3% HF), and ball sealers for providing fluid diversion away from the upper zone and into the lower two zones. Ball sealers were selected having density in the range from 1.050–1.060 g/cm$^3$). Ball sealers having the above density were selected so that they would be readily transported to the perforations by the treating fluids at the anticipated matrix injection rate of 2–3 BPM.

The treatment was designed to seal off 94 of the 112 perforations present in the three intervals. The treating rate averaged about 2½ BPM and the bottomhole treating pressure averaged about 2100 psi, a pressure well beneath the fracturing pressure of this formation. Pressure increases of up to 200 psi were observed as the ball sealers sealed off perforations and diverted the acids into unacidized regions. Upon completion of the acid stimulation, injectivity had increased to 4.5 BPM at 950 psi surface pressure in contrast to 1 BPM at 1000 psi initially. A temperature survey conducted following the treatment indicated that all three zones were stimulated.

2. In a second test it was required that a matrix acid treatment be conducted on two productive intervals in a carbonate formation located at a depth of 15,700 feet. The two productive intervals were flanked above and below by previously fractured intervals. Utilizing the methods of this invention, buoyant ball sealers were used to successfully matrix acidize the two interior intervals.

In this treatment ball sealers having a density range from 1.10 to 1.11 g/cm$^3$ were utilized in conjunction with 28 percent HCl having a density of 1.14 g/cm$^3$, so that the ball sealers would be buoyant with respect to the stimulation fluid. Acid and ball sealers were staged so that 330 ball sealers would be available in the first 110 bbls of 28 percent HCl to preferentially close off the fractured zones. An additional 150 bbls of 28 percent HCl was injected with ball sealers to treat the remaining 82 perforations in the two zones requiring the matrix acidization. The treatment was carried out at a rate of 8–13 PBM with bottomhole pressure under 8000 psi, such conditions being suitable for matrix acidizing this deep carbonate formation. During the treatment, the average bottomhole pressure continually rose in response to ball sealers sealing off perforations and diverting the hydrochloric acid into other unstimulated regions.

Following the treatment, a downhole flowmeter survey was conducted to definitively ascertain whether all zones had been stimulated and were currently producing. Results of that survey clearly indicated all intervals were contributing to production, thereby establishing that the treatment had been diverted away from the two fractured intervals leading to a successful matrix stimulation of the remaining two intervals. Overall results included a productivity increase from 2800 BOPD at 390 psi to 4600 BOPD at 1000 psi flowing tubing pressure.

The principle of the invention and the best mode in which it is contemplated to apply that principle have been described. Although the present invention has been discussed primarily with regard to matrix rate acid treatments, it should be emphasized that other types of well treatment operations conducted at matrix rates and applying the principles of the present invention can be employed. For example, any other type of well treatment wherein a carrying fluid is transporting ball sealers to casing perforations can utilize the techniques of the present invention. Specific examples would be solvent stimulation treatments, surfactant stimulation treatments, inhibitor injection treatments, oil, water or emulsion injections, and certain types of squeeze cementing operations. Therefore, it is to be understood that the foregoing examples were illustrative only and that other treatments, operations and techniques can be employed without departing from the true scope of the invention defined in the claims.

What is claimed is:

1. A method of sealing perforations in a well casing comprising:

injecting into said casing a carrying fluid containing ball sealers having a tentacle-free outer surface and a density less than that of the carrying fluid, said fluid being injected at a matrix flow rate which is less than that which would fracture a formation surrounding said casing and at a velocity which is sufficient to overcome the buoyancy of said ball sealers and downwardly transport them to the perforations to be sealed.

2. The method of claim 1 wherein said carrying fluid is a treating fluid which flows through unsealed perforations and into said formation.

3. The method of claim 2 wherein said treating fluid contains an acid.

4. The method of claim 1 wherein said ball sealers are downwardly transported to the perforations at a rate which will allow them to seat on the perforations within the time necessary to inject the carrying fluid.

5. A method for injecting a fluid into a subterranean formation surrounding a perforated casing which comprises:

injecting into the casing a carrying fluid containing ball sealers having a tentacle-free outer surface and a density less than that of the treating fluid, said treating fluid being injected at a matrix flow rate which is less than that which would fracture said formation and at a velocity which is sufficient to overcome the buoyancy of the ball sealers and to downwardly transport said ball sealers to the casing perforations until they seat on the desired number of perforations to be sealed.

6. The method of claim 5 wherein said carrying fluid is a treating fluid which flows through unsealed perforations and into said formation.

7. The method of claim 6 wherein said treating fluid contains an acid.

8. The method of claim 5 wherein the ball sealers seat on the perforations to be sealed with 100 percent seating efficiency.

9. The method of claim 5 wherein said ball sealers are downwardly transported to the perforations at a rate which will allow them to seat on the perforations within the time necessary to inject the carrying fluid.

10. A method for injecting a fluid into a subterranean formation surrounding a perforated casing which comprises:

injecting into the casing a carrying fluid at a matrix flow rate which is less than that which would fracture the formation; and introducing into said carrying fluid ball sealers having a tentacle-free outer surface and a density less than that of the carrying fluid but having a buoyancy which is overcome by the downward velocity of the carrying fluid so that the ball sealers are transported down the casing to the perforations at a rate which will allow them to seat on the desired number of perforations to be sealed within the time necessary to inject the carrying fluid.

11. The method of claim 10 wherein said carrying fluid is a treating fluid which flows through unsealed perforations and into said formation.

12. The method of claim 11 wherein said treating fluid contains an acid.

13. The method of claim 10 wherein the relative upward velocity of the ball sealers is no greater than about one-third of the downward velocity of the carrying fluid.

14. The method of claim 10 wherein the ball sealers seat on the perforations to be sealed with one hundred percent seating efficiency.

15. A method for matrix acidizing a subterranean formation surrounding a perforated casing which comprises:

injecting into the casing an acid-bearing fluid at a matrix flow rate which is less than that which would fracture said formation;

introducing into said fluid ball sealers having a tentacle-free outer surface and a density less than that of the fluid but having a buoyancy which is overcome by the downward velocity of the fluid so that the ball sealers are transported down the casing at a rate which will allow them to seat on the desired number of perforations to be sealed within the time necessary to inject the fluid; and continuing the injection of said acid-bearing fluid after the ball sealers are seated on the perforations so that the fluid may be diverted through unsealed perforations and into the formation whereupon the formation is matrix acidized.

16. The method of claim 15 wherein the ball sealers seat on the perforations to be sealed with one hundred percent seating efficiency.

17. A method of treating a subterranean formation surrounding a cased wellbore wherein said casing has an interval provided with a plurality of perforations, said method comprising:

flowing down said casing a fluid having suspended therein ball sealers having a tentacle-free outer surface and a density less than that of the fluid, the flow rate of said fluid being less than that which would fracture the formation but sufficiently high to impart a downward drag force on the ball sealers to overcome the buoyancy force of the ball sealers whereby said ball sealers are transported to the perforated interval; and continuing the flow of said fluid down said casing to cause some of the ball sealers to seat on the perforations within a portion of the perforated interval thereby reducing the fluid flow within said portion to a rate which imparts a downward drag force on the ball sealers suspended within said portion which is less than the upward buoyancy forces thereon, whereby said ball sealers suspended in said fluid within said portion will rise to an elevation wherein the fluid drag forces are sufficient to cause said ball sealers to seat on unsealed perforations.

* * * * *